US010190249B2

(12) United States Patent
Sarikhani et al.

(10) Patent No.: US 10,190,249 B2
(45) Date of Patent: Jan. 29, 2019

(54) APPLIANCE CONTROL UNIT WITH ARRANGED CONTROL SWITCHES

(71) Applicant: Whirlpool Corporation, Benton Harbor, MI (US)

(72) Inventors: Ali Sarikhani, Wichita, KS (US); Maciej Tubielewicz, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 377 days.

(21) Appl. No.: 15/061,028

(22) Filed: Mar. 4, 2016

(65) Prior Publication Data

US 2017/0256942 A1 Sep. 7, 2017

(51) Int. Cl.

| | |
|---|---|
| ***D06F 33/02*** | (2006.01) |
| ***A47L 15/46*** | (2006.01) |
| *A47L 15/42* | (2006.01) |

(52) U.S. Cl.

CPC ..... *D06F 33/02* (2013.01); *A47L 15/46* (2013.01); *A47L 15/4274* (2013.01)

(58) Field of Classification Search

None

See application file for complete search history.

(56) References Cited

U.S. PATENT DOCUMENTS

| | | | | |
|---|---|---|---|---|
| 4,241,400 | A * | 12/1980 | Kiefer | D06F 33/02 134/57 D |
| 5,202,582 | A | 4/1993 | Szynal et al. | |
| 5,600,310 | A | 2/1997 | Whipple, III et al. | |
| 5,760,493 | A | 6/1998 | Outcalt et al. | |
| 7,642,620 | B2 | 1/2010 | Tanaka | |
| 2012/0239840 | A1 | 9/2012 | Pimputkar et al. | |

* cited by examiner

*Primary Examiner* — Thienvu Tran
*Assistant Examiner* — David M Stables
(74) *Attorney, Agent, or Firm* — McGarry Bair PC

(57) ABSTRACT

An appliance for treating at least one item according to a cycle of operation and configured to receive power from a power source having an AC voltage line and a neutral line includes a treating chamber for receiving the item and a central control unit to control independent electrical loads associated with the cycle of operation. The central control unit includes a plurality of parallel controlled master switches in the AC voltage line and a plurality of parallel controlled slave switches in the neutral line. The master and slave switches define a number of independent loads equal to the number of the master switches multiplied by the number of the slave switches.

15 Claims, 4 Drawing Sheets

| | $S_1$ | $S_2$ | $S_3$ | ... | $S_K$ |
|---|---|---|---|---|---|
| *Neutral* | *1* | *2* | *3* | ... | $K$ |
| *Neutral* | *1* | *2* | *3* | ... | $K$ |
| *Neutral* | *1* | *2* | *3* | ... | $K$ |
| ... | *1* | *2* | *3* | ... | $K$ |
| *Neutral* | *1* | *2* | *3* | ... | $K$ |

FIG. 4

APPLIANCE CONTROL UNIT WITH ARRANGED CONTROL SWITCHES

BACKGROUND OF THE INVENTION

Home appliances generally have controls that permit a user to select various cycles of operation via inputs to a human-machine interface. An appliance control unit receives the user inputs and controls the operation of various components of the home appliance. These components represent the electrical loads connected to the appliance control unit, which controls the supply of power to the loads. The loads are normally switched to be selectively turned on and off as required by the selected cycle of operation. Generally, the appliance control unit includes an independent switch for each electrical load.

BRIEF DESCRIPTION OF THE INVENTION

In one embodiment, an appliance for treating at least one item according to a cycle of operation and configured to receive power from a power source having an AC voltage line and a neutral line comprises a treating chamber for receiving the item and a central control unit to control independent electrical loads associated with the cycle of operation. The central control unit comprises a first plurality of parallel controlled master switches in the AC voltage line and a second plurality of parallel controlled slave switches in the neutral line thereby defining a number of independent loads equal to the number of the first plurality multiplied by the number of the second plurality.

BRIEF DESCRIPTION OF THE DRAWINGS

In the drawings:

FIG. 4 shows a time categorization of loads in the switch array of FIG. 3

DESCRIPTION OF EMBODIMENTS OF THE INVENTION

While the invention can be implemented in any appliance having a control unit that supplies power to multiple electrical loads, it is currently exemplified to be implemented in a dishwasher. However, the appliance can be a home or domestic appliance that performs a particular job in a home, including those relating to cleaning, cooking, or food preservation including, but not limited to, a refrigerator, a clothes washing machine, a clothes dryer, a freezer, a range, a stove, an oven, a microwave or a cooktop. All of these examples of home appliances can treat one or more items according to a cycle of operation. Thus, a brief summary of the contemplated environment in the context of a dishwasher should aid in a more complete understanding.

Figure 1:
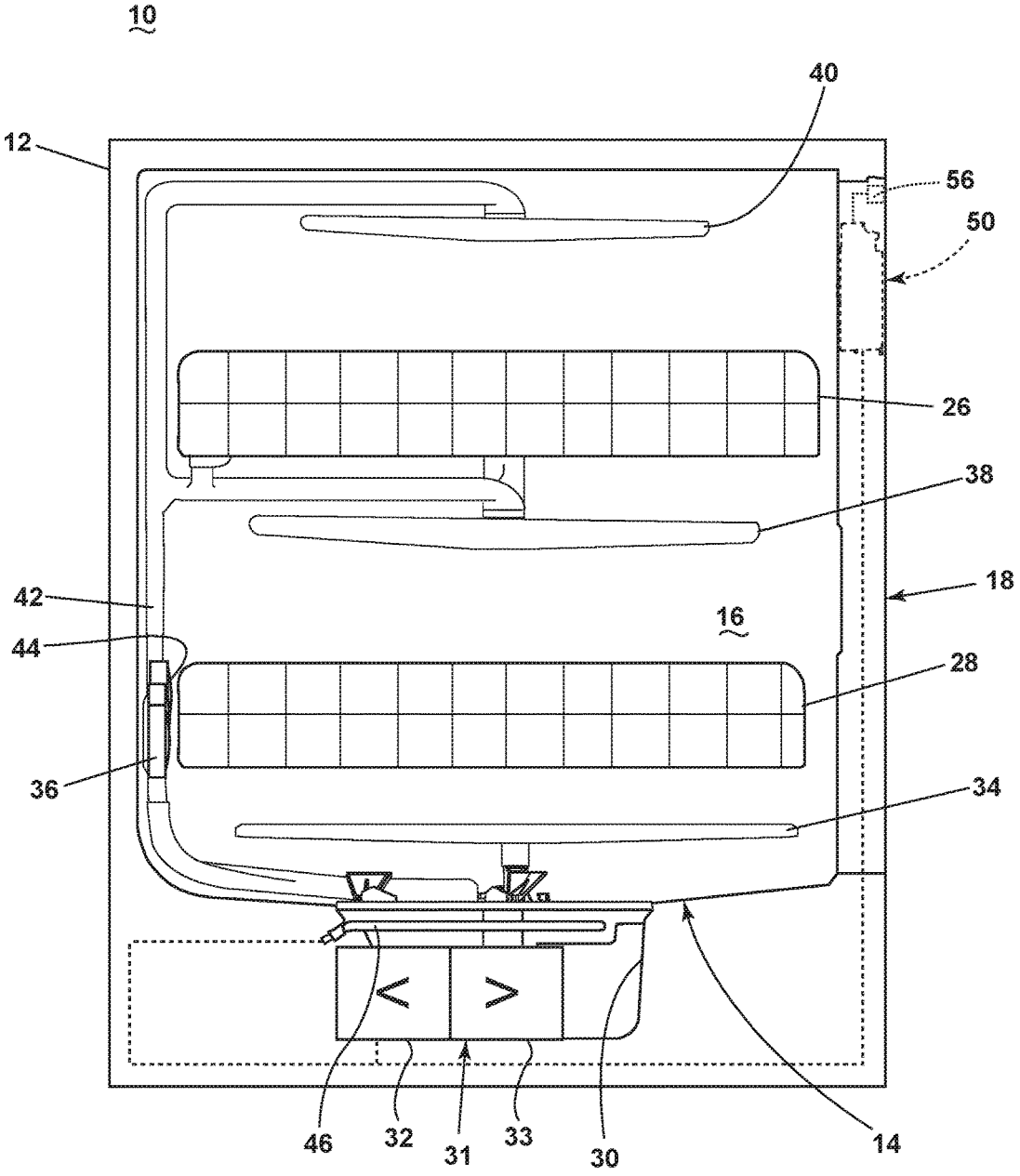
FIG. 1 is a schematic, cross-sectional view of a dishwasher according to a first embodiment of the invention.

In FIG. 1, an automated dishwasher 10 is illustrated. The dishwasher 10 shares many features of a conventional automated dishwasher, which will not be described in detail herein except as necessary for a complete understanding of the invention. A chassis 12 defines an interior of the dishwasher 10 and can include a frame, with or without panels mounted to the frame. An open-faced tub 14 can be provided within the chassis 12 and can at least partially define a treating chamber 16, having an open face, for washing dishes. A door assembly 18 can be movably mounted to the dishwasher 10 for movement between opened and closed positions to selectively open and close the open face of the tub 14. Thus, the door assembly 18 provides access to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 30 and a pump assembly 31. The sump 30 collects the liquid sprayed in the treating chamber 16 and can be formed by a sloped or recess portion of a bottom wall of the tub 14. The pump assembly 31 can include both a drain pump 32 and a recirculation pump 33. The drain pump 32 can draw liquid from the sump 30 and pump the liquid out of the dishwasher 10 to a household drain line (not shown). The recirculation pump 33 can draw liquid from the sump 30 and the liquid can be simultaneously or selectively pumped through a supply tube 42 to each of the assemblies 34, 36, 38, 40 for selective spraying. While not shown, a liquid supply system can include a water supply conduit coupled with a household water supply for supplying water to the treating chamber 16.

A heating system including a heater 46 can be located within the sump 30 for heating the liquid contained in the sump 30.

A central control unit 50 can also be included in the dishwasher 10, which can be operably coupled with various components of the dishwasher 10 to implement a cycle of operation. The central control unit 50 can be located within the door 18 as illustrated, or it can alternatively be located somewhere within the chassis 12. The central control unit 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the central control unit 50 and receive information.

Figure 2:
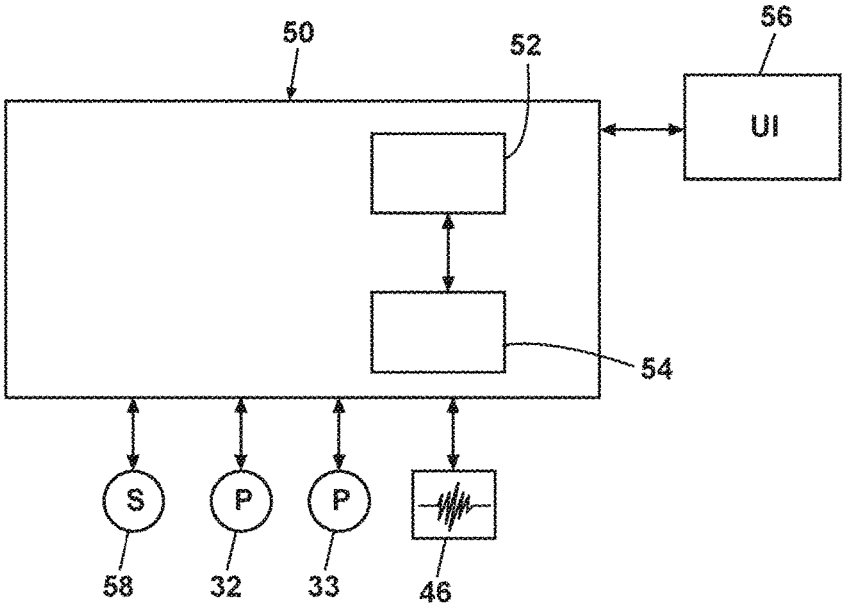
FIG. 2 is a schematic view of a central control unit of the dishwasher of FIG. 1.

As illustrated schematically in FIG. 2, the central control unit 50 can be coupled with the heater 46 for heating the wash liquid during a cycle of operation, the drain pump 32 for draining liquid from the treating chamber 16, and the recirculation pump 33 for recirculating the wash liquid during the cycle of operation. The central control unit 50 can be provided with a memory 52 and a central processing unit (CPU) 54. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10. The central control unit 50 can also receive input from one or more sensors 58. Non-limiting examples of sensors that can be communicably coupled with the central control unit 50 include a temperature sensor and turbidity sensor to determine the soil load associated with a selected grouping of dishes, such as the dishes associated with a particular area of the treating chamber.

To initiate and control a cycle of operation, the central control unit 50 selectively couples electrical power from a power source to one or more electrical loads associated therewith. For a typical dishwasher appliance, the electrical loads can include, but not be limited to, the electrical circuits that energize and actuate the drain pump 32, the recirculation pump 33, one or more heaters such as the heater 46 for heating the wash liquid or an air heater, a water valve, a detergent dispenser and a wetting agent dispenser.

Figure 3:
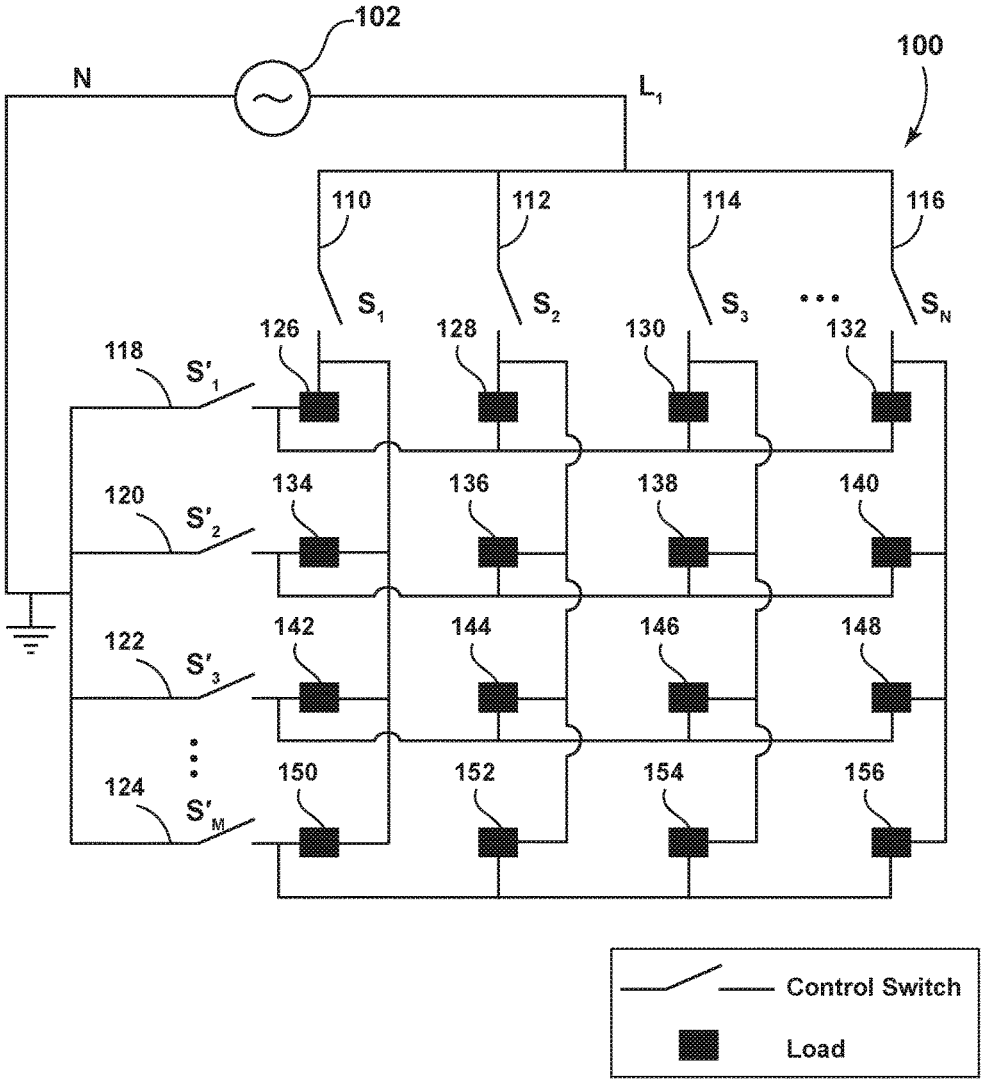
FIG. 3 is schematic view of a switch array in the central control unit of FIG. 2.

Referring now to FIG. 3, a switch array 100 is provided for selectively coupling power from a power source 102 to a set of independent electrical loads 126-156. The power source 102 can be an AC power source where one side of the power source 102 is grounded and commonly referred to as neutral (N). The ungrounded side of the power source is referred to as the line ($L_1$). The switch array 100 is an element of the central control unit and can be physically attached thereon or can be electrically coupled via one or more wired connections. A plurality of master switches ($S_1$, $S_2$, $S_3$, . . . $S_n$) 110-116 are coupled in parallel to the line, $L_1$. A plurality of slave switches ($S'_1$, $S'_2$, $S'_3$, . . . $S'_m$) 118-124 are coupled in parallel to the neutral, N.

Each of the master switches 126-132 can selectively couple the line $L_1$ to a subset of electrical loads 126-156. For example, when switch $S1_1$ (110) is closed, the line $L_1$ is coupled to electrical loads 126, 134, 142, and 150. When any one or more of slave switches $S'_1$, $S'_2$, $S'_3$, . . . $S'_m$ (118-124) is also closed the respective load is energized. Each load may be categorized as an independent operation needed to energize a component in the dishwasher. For example, operation of two heater relays may require nine (9) controlled switches to perform eight (8) independent operations. In the example of FIG. 3, there are 16 possible loads 126-156, at least one or more of which may be an independent operation. Operation of a component may require five controlled switches, one master switch and four slave switches, to operate four loads. The current handling capacity of any master switch $S_1$, $S_2$, $S_3$, or $S_4$ (110-116) may be derived from equation (1):

$$IS_N \geq \Sigma_{i=1}^{M} IS'_i \tag{1}$$

where $IS'_i$ is the current passing from any single master switch $S_n$ and the slave switches $S'_m$. In other words, for example, if all of the loads 126, 134, 142, and 150 are connected to the master switch $S_1$ and slaves $S'_1$, $S'_2$, $S'_3$, . . . $S'_m$ are simultaneously on, then the trace and the switch of $S_1$ should be able to carry the summation of all current passing from the slaves $S'_1$, $S'_2$, $S'_3$, . . . $S'_m$. Preferably, each master switch is a sugar cube relay and the slave switches are triac power switches.

From the concept of the switch array 100 it can be seen that the number of controlled switches needed for cycles of operation in the dishwasher 10 might be reduced. Assume that at the end of a cycle of operation both the line $L_1$ and the neutral N are isolated inside the central control unit 50. Further assume that the neutral N can be used in both a controlled and uncontrolled manner. This allows the independent in time operation of the switches.

Consider for example that the switch array 100 comprises four (4) master switches and eight (8) slave switches, and that 9 switches are required to operate a component in the dishwasher 10. The following master-slave arrangement shows different capacities in the independent operations or loads for the component:

{master=1,slaves=8}={independent operations=1×8=9}

{master=2,slaves=7}={independent operations=2×7=14}

{master=3,slaves=6}={independent operations=3×6=18}

{master=4,slaves=5}={independent operations=4×5=20}

It is seen that the maximum number of independent operations is achieved when the difference between the number of master switches and slave switches is minimized, i.e., the following state:

{master=4,slaves=5}={independent operations=4×5=20}.

Similarly if one wanted to determine a minimum number of switches in the switch array 100 that are needed to achieve 9 independent operations, one can use the following exemplary arrangements:

{master=1,slaves=8}={independent operation=1×8=9}

{master=3,slaves=3}={independent operation=3×3=9}

It can be seen that with three master switches and three slave switches, a minimum number of switches (6) are used to achieve the same number of independent operations (9).

The loads 126-156 can be categorized as independent operations as discussed above, and they can also be categorized as time independent. If loads 126-156 are categorized into N time independent groups, then one can further have K time independent operations without adding additional switches. FIG. 4 shows a time categorization of the loads into K groups. It is seen that without having slave switches, one can have K independent operations. Design of operation cycles is connected to the number of the switches. Here, the total number of time independent operations will be M×(K+

1). In this kind of operation, the reverse wire condition leads to energizing one side of the load terminal even when the dishwasher cycle is not activated.

Given the time independent categorization into three time independent groups 1, 2, and 3, one can further reduce the number of switches to five, i.e., {master=3, slaves=2}. The proposed number of master and slave switches in this case include the following arrangements:

$\{S_1=2, S'_i=3\}$, $\{S_1=3, S'_i=3\}$, $\{S_1=3, S'_i=4\}$, $\{S_1=4, S'_i=4\}$, $\{S_1=4, S'_i=5\}$, $\{S_1=5, S'_i=5\}$.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A household appliance for treating at least one item according to a cycle of operation and configured to receive power from a power source having an AC voltage line and a neutral line, the household appliance comprising:

a treating chamber for receiving the item; and a central control unit to control independent electrical loads associated with the cycle of operation;

wherein the central control unit of the household appliance comprises a first plurality of parallel controlled master switches in the AC voltage line and a second plurality of parallel controlled slave switches in the neutral line thereby defining a number of independent loads equal to the number of the first plurality multiplied by the number of the second plurality.

2. The household appliance of claim 1 wherein a difference between the number of the first plurality and the number of the second plurality is minimized.

3. The household appliance of claim 1 wherein at least some of the loads of the number of independent loads are time independent, thereby defining time independent loads equal to the at least some of the independent loads multiplied by the number of time independent loads plus one.

4. The household appliance of claim 1 wherein the first plurality comprises sugar cube relays.

5. The household appliance of claim 1 wherein the second plurality comprises triac power switches.

6. The household appliance of claim 1 wherein a current handling capacity of any of the first plurality of parallel controlled master switches is enough to carry a summation of all current passing from the second plurality of parallel controlled slave switches.

7. A control unit for a household appliance that requires independent electrical loads associated with a cycle of operation, comprising:

a first plurality of parallel controlled master switches coupled to an AC voltage line; and a second plurality of parallel controlled slave switches coupled to an AC neutral line associated with the AC voltage line;

wherein the number of independent loads associated with the cycle of operation for the control unit for the household appliance is equal to the number of the first plurality multiplied by the number of the second plurality.

8. The control unit of claim 7 wherein a difference between the number of the first plurality and the number of the second plurality is minimized.

9. The control unit of claim 7 wherein at some of the loads of the number of independent loads are time independent, thereby defining time independent loads equal to the number of the first plurality multiplied by the number of independent loads plus one.

10. The control unit of claim 7 wherein the first plurality comprises sugar cube relays.

11. The control unit of claim 7 wherein the second plurality comprises triac power switches.

12. The control unit of claim 7 wherein a current handling capacity of any of the first plurality of parallel controlled master switches is enough to carry a summation of all current passing from the second plurality of parallel controlled slave switches.

13. A method of determining a number of switches needed to control a cycle of operation in an appliance configured to receive power from a power source having an AC voltage line and a neutral line, the method comprising:

organizing loads in an array of parallel master switches and parallel slave switches based upon a number of independent operations required by the cycle of operation;

determining a set of parallel master switches and parallel slave switches needed to complete the independent operations to perform the cycle of operation; and calculating a maximum number of independent operations based on combinations of master switches and slave switches in the set.

14. The method of claim 13 wherein the calculating comprises identifying a minimum difference between the number of master switches and the number of slave switches in the combinations of master switches and slave switches in the set.

15. The method of claim 13 further comprising:

categorizing the loads into time independent groups;

determining a total number of time independent operations based on the categorized groups; and calculating a minimum number of switches based on the total number of time independent operations.

* * * * *